US006764408B1

(12) United States Patent
Coleman

(10) Patent No.: US 6,764,408 B1
(45) Date of Patent: Jul. 20, 2004

(54) INFLATABLE STRUCTURE WITH SUSPENDED FEATURES

(76) Inventor: Russell Coleman, 9 Calle Del Mar, Pomona, CA (US) 91766

( * ) Notice: Subject to any disclaimer, the term of this patent is extended or adjusted under 35 U.S.C. 154(b) by 0 days.

(21) Appl. No.: 10/290,480

(22) Filed: Nov. 5, 2002

Related U.S. Application Data

(60) Provisional application No. 60/338,741, filed on Nov. 5, 2001.

(51) Int. Cl.[7] ..... A63G 31/112

(52) U.S. Cl. ..... 472/134; 472/50

(58) Field of Search ..... 472/134, 135, 472/136, 49, 50, 118, 80; 182/12, 13, 48; 482/35, 36, 37, 38, 39

(56) References Cited

U.S. PATENT DOCUMENTS 4,159,113 A * 6/1979 Callecod ..... 482/36
4,633,974 A * 1/1987 Weiner et al. ..... 182/3
5,167,595 A * 12/1992 Gleeson et al. ..... 482/35
5,226,864 A * 7/1993 Showers ..... 482/35
5,462,505 A * 10/1995 Blair et al. ..... 482/27
5,678,357 A * 10/1997 Rubio et al. ..... 52/2.17
5,690,584 A * 11/1997 Strawcutter et al. ..... 482/35
5,769,725 A * 6/1998 Ogden et al. ..... 472/59
5,772,535 A * 6/1998 Murphy ..... 473/415

* cited by examiner

*Primary Examiner*—Kien T. Nguyen
(74) *Attorney, Agent, or Firm*—Knobbe Martens Olson & Bear LLP

(57) ABSTRACT

An inflatable game incorporating a flexible, inflated structure filled with gas, suitable for users to jump and bounce thereupon and a suspended structure that permits users to be suspended above the inflatable structure. The suspended structure may be a zip line, a bridge, or the like. The suspended structure allows users to move from one elevated position on the inflatable structure to another elevated position. The inflatable structures used in conjunction with suspended features provide an added variety of activities to the user. For example, users can hang in midair, drop onto the inflatable structure from elevated heights, engage in competitive activities.

7 Claims, 3 Drawing Sheets

INFLATABLE STRUCTURE WITH SUSPENDED FEATURES

RELATED APPLICATION

This Application claims the benefit of U.S. Provisional Application No. 60/338,741 filed on Nov. 5, 2001 which is incorporated by reference in its entirety.

BACKGROUND OF THE INVENTION

1. Field of the Invention

This invention relates to inflatable games, and more particularly to an inflatable game that incorporates features designed to suspend people above ground for fun and entertainment.

2. Description of the Related Art

For many years, inflatable games have amused and entertained young and old persons alike. The typical inflatable game is a large, flexible air-filled structure taking on a variety of shapes such as a castle, a pyramid, a pirate ship, and the like. Most inflatable games have at least one air-filled horizontal mattress upon which people, typically children, can jump and bounce. The air-filled jumping surface typically provides spring back making trampoline-type play possible, such that users can jump and bounce to higher heights than normal. The inflatable games are usually large enough for multiple persons to use at the same time. In some instances, the inflatable games can be twenty (20) feet high and one hundred twenty (120) square feet wide. Furthermore, since the inflatable structures are filled with air and the surfaces are relatively soft, users can fall on the inflatable mattress with little fear of injury. Hence, the inflatable games provide a great deal of safe entertainment especially for young children.

In recently years, the increasing popularity of inflatable games has led some game manufacturers to make inflatable games that are more sophisticated and contain more features than just an inflatable mattress. For instance, some inflatable games now include slides, obstacle courses, and other features for playing physically challenging games like tug-of-war. In addition to jumping and bouncing, these alternative inflatable games allow for a variety of different activities, all of which could be engaged with little fear of injury. As more features are added, the user is treated to an ever widening variety of games and activities to engage in, thereby enhancing the user's experience with the inflatable games. In an effort to keep their customers entertained, inflatable game manufacturers are constantly seeking more features to include in their games.

Moreover, it is also generally known that the added elevation and the thrill of being suspended in midair can be very exciting for people seeking amusement. Consequently, zip lines and suspended bridges have always been popular activities at amusement parks, fairs, and carnivals. However, Applicant is not aware of any inflatable game that incorporates features designed to suspend people in midair. This may be partly due to the difficult of utilizing inflatable structures to structurally support a person suspended in midair. Inflatable structures are generally too soft and pliable to withstand the load of the weight of the suspended structure loaded together with the person. In fact, the side walls of most conventional inflatable structures are likely to sag and crumble under the weight of a person riding for example a zip line. Hence, it will be appreciated that there is a need for an inflatable game that incorporates features that can suspend a person in midair. To this end, there is a particular need for an inflatable structure that is designed to withstand the load of the combined weight of a suspended structure together with a person hanging from the structure.

SUMMARY OF THE INVENTION

The aforementioned needs are satisfied by the snow sliding apparatus of the preferred embodiments of the present invention. In one aspect, the preferred embodiments provide an inflatable game that incorporates an inflatable structure in conjunction with a suspended feature that is configured to suspend a person in midair over the inflatable structure. In one embodiment, the suspended feature is supported by two inflatable supporting structures wherein the inflatable supporting structures are dimensioned to support the weight of the suspended feature and the person. In one embodiment, the ratio of the width to the height of the supporting wall is at least 1 to 2 so as to inhibit the supporting wall from sagging or toppling over. Preferably, the supporting wall has sufficient mass so that it is less likely to sag when the suspended feature is being used. In one embodiment, the suspended feature comprises a zip line. In another embodiment, the suspended feature comprises a suspended bridge.

In another aspect, the preferred embodiments provide an inflatable game comprising an inflatable mattress and a suspended feature that extends over the inflatable mattress. In one embodiment, the suspended feature comprises a zip line that is attached to rigid structures positioned adjacent the inflatable mattress. In another embodiment, the suspended feature comprises a suspended bridge that is attached to rigid structures positioned adjacent the inflatable mattress.

In yet another aspect, the preferred embodiments provide an inflatable game that is designed to suspend a person in midair over a cushioned surface. In one embodiment, the person can be suspended via a tie line over a horizontal inflatable structure. In another embodiment, the person can be suspended via a hollow tube over a horizontal inflatable structure. These and other advantages of the present invention will become more fully apparent from the following description taken in conjunction with the accompanying drawings.

DETAILED DESCRIPTION OF THE PREFERRED EMBODIMENTS

Figure 1:
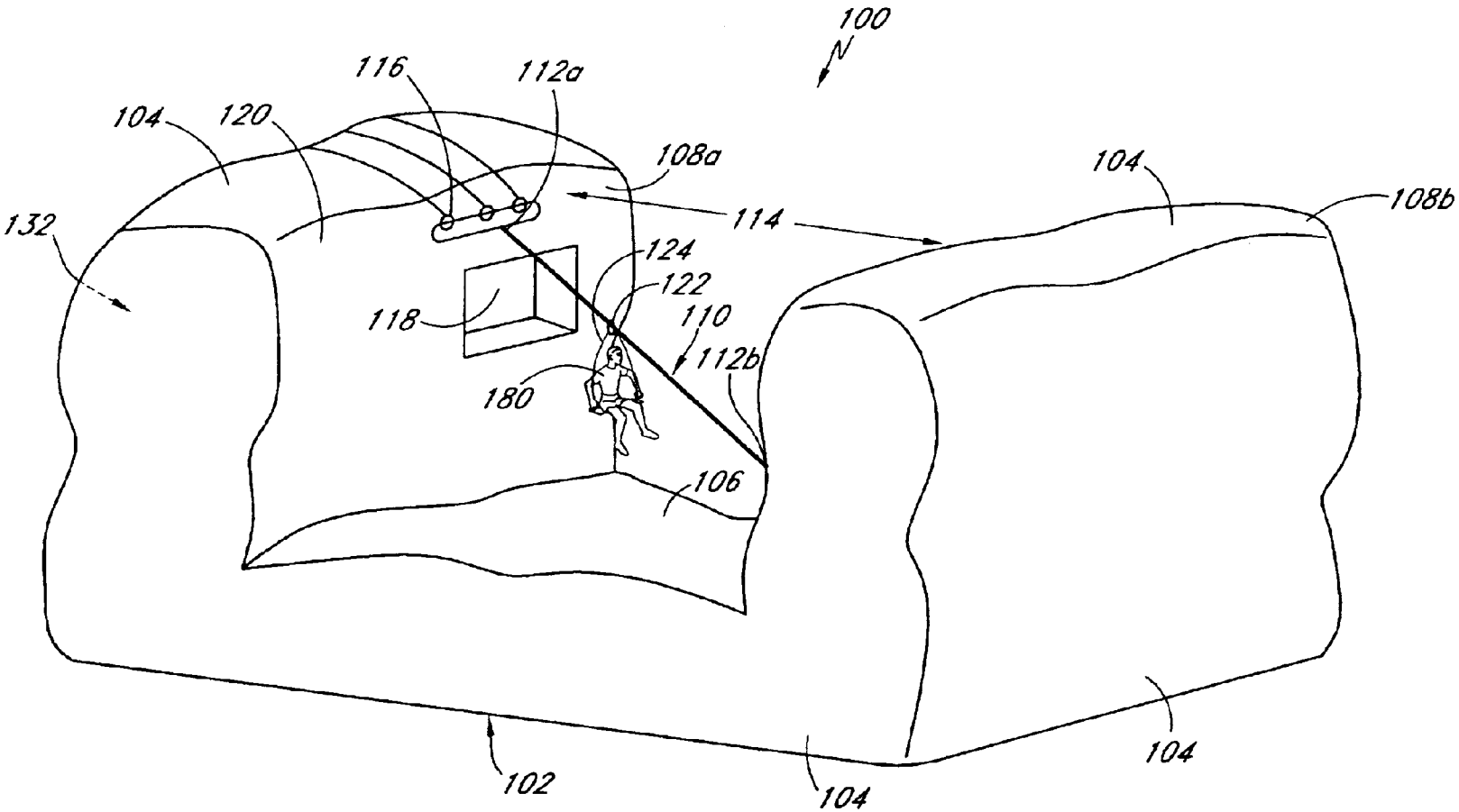
FIG. 1 is a perspective view of one embodiment of an inflatable game incorporating a zip line.

Reference will now be made to the drawings wherein like numerals refer to like parts throughout. FIG. 1 illustrates an inflatable game 100 of one preferred embodiment. As shown in FIG. 1, the inflatable game 100 generally comprises an inflatable structure 102 that is filled with a fluid such as gas. In one embodiment, the inflatable structure 102 comprises a plurality of flexible sheets 104 that are assembled together in a known manner. Preferably, the sheets 104 are sewn, glued, sealed or otherwise attached together in a manner such that seams between the individual sheets 104 are air-tight so as to inhibit leakage of air. The sheets 104 can be made of vinyl or other suitable material. The size and shape of the sheets 104 and their arrangement, once assembled, define the general shape of the inflatable structure 102. It is understood that the inflatable structure 102 can take on a variety of different shapes, such as castles, pirate ships, pyramids, and the like, without departing from the spirit of the invention.

In the embodiment as showing in FIG. 1, the inflatable structure 102 comprises a three-dimensional U-shaped structure having a horizontal mattress 106 that extends between two vertical walls 108*a*, 108*b*. Preferably, the horizontal mattress 106 is dimensioned and inflated in a manner such that people can fall or jump on the mattress 106 and be sufficiently cushioned by the air contained therein. In one embodiment, the horizontal mattress 106 is about 6 feet thick, 54 feet long, and 24 feet wide. However, it can be appreciated that the dimension of the inflatable structure can vary without departing from the scope of the invention.

As FIG. 1 further shows, a cable 110 extends between the two vertical walls 108*a*, 108*b*. The cable 110 functions as a zip line along which people can slide from one end to the other. Preferably, the cable 110 is made of a high-strength material capable of withstanding many times the average weight of an adult human. Moreover, the cable 110 preferably has a low elasticity such that it does not flex considerably under regular loading. In the embodiment shown, the ends 112*a*, 112*b* of the zip line 110 are attached to the two vertical walls 108*a*, 108*b* in a manner such that the zip line 110 is sloped at an angle so as to enable a person to slide from the first end 112*a* of the line to the other 112*b*. Advantageously, the zip line 110 extends along the first distance 114 so as to allow a person 180 to travel over the first distance 114 while being suspended midair above the inflated mattress 106 which provides a safe cushion for the person to fall on.

In one embodiment, the vertical walls 108*a*, 108*b* are designed in a manner such that they will only sag slightly when the zip line 110 is in use. Preferably, the ratio of the width to the height of each vertical wall 108*a*, 108*b* is at least 1 to 2 so as to inhibit the vertical walls 108*a*, 108*b* from sagging or toppling over when the user is hanging from the zip line 110. However, it is understood that the dimensions of the walls comprising the inflatable structure can vary depending upon the desired final shape, and such variance does not depart from the spirit of the invention. In some embodiments, one or both vertical walls 108*a*, 108*b* can be supported by additional inflatable structures that are positioned adjacent to the vertical walls 108*a*, 108*b* so as to provide additional mass for the structure, which further reduces the likelihood of sagging or toppling from the weight of the person hanging from the zip line. For example, each vertical wall 108*a*, 108*b* can be connected to an additional inflatable mattress (not shown) positioned behind the walls.

FIG. 1 also shows the manner in which the zip line 110 is attached to the vertical walls 108*a*, 108*b* of the inflatable structure 102. In the embodiment shown, each end 112*a*, 112*b* of the zip line 110 is threaded through a plurality of retainers 116 such as metal rings that are attached to an interior surface 120 of the vertical walls 108*a*, 108*b* at an appropriate height so as to suspend the zip line 110 above the inflatable mattress 106. Advantageously, the use of multiple retainers distributes the load that is induced on the vertical walls 108*a*, 108*b* when the zip line 110 is in use. However, in other embodiment, a single retainer can be used to attach the ends of the zip line to each interior surface of the vertical walls or the end of the zip line can be directly attached to the vertical wall. As FIG. 1 further shows, an opening 118 is formed in the vertical wall 108 wherein the opening 118 extends from an interior surface 120 to an exterior surface 132 of the vertical wall. Preferably, the opening 118 serves as a place where people can stand before sliding down the zip line 110.

Moreover, in some embodiments, a sliding member 122 such as a harness can be detachably attached to the zip line. Preferably, the sliding member 122 is configured to carry a person while the person slides along the zip line 110. In another embodiment, the sliding member 122 also includes a perch 124 for a person to sit on while the sliding member 122 moves along the zip line 110. In one embodiment, the perch 124 also comprises additional retaining straps (not shown) which keep the rider 180 secured to the sliding member 122 even when the rider 180 is not actively holding on to the sliding member 122. This embodiment of the sliding member 122 is relatively safe because the retaining straps inhibit the person from inadvertently falling out of the sliding member 122 during travel. In other embodiments, the sliding member 122 comprises a bar that can be attached to the zip line 110 in a known manner. Preferably, the bar is configured for the person to hold onto while sliding along the zip line 110. Using a bar as the sliding member allows more people to ride along the zip line 110 in a less amount of time because users 180 simply have to grab the bar before moving along the zip line 110. Moreover, in addition to gliding down the zip line, the person 180 can also climb and hang on the zip line 110 while being suspended in midair, giving the user 180 an enjoyable play activity.

The inflatable structure 100 of FIG. 1 incorporates the zip line 110 to thereby provide the rider 180 with a wider array of activities than those currently available in the art. For example, the sliding member 122 can move the person 180 along the length of the zip line 110 under the force of gravity. If the slope of the zip line 110 is large, the user 180 may reach considerable speeds. Furthermore, the person 180 can even complete the travel by dropping onto the soft, bouncy horizontal mattress 106 of the inflatable structure 102. The zip line 110 can be used in a competitive game, wherein the person 180, while strapped into the sliding member 122, is challenged to move up the zip line 110 using only arm strength. If there are several people 180, the people 180 could compete and try to achieve this task in the shortest amount of time. Moreover, people 180 can also climb along the zip line 110 without using the sliding member 122 and drop from the elevated height onto the horizontal mattress 106 for an exciting free fall. Thus, addition of the zip line 110 allows for additional activities to thereby increase people's 180 enjoyment of the inflatable game 100. Moreover, it can be appreciated that the inflatable structure shown in FIG. 1 can also represent part of a larger inflatable structure.

In another embodiment not shown, the zip line is not attached to the inflatable structure. Instead, the zip line is attached to separate structures that are positioned near the inflatable structure, and the zip line extends over the inflatable structure and allows the same types of activities described hereinabove. For example, in one embodiment, the zip line is attached to vertical poles positioned at opposite ends of the inflatable structure such that the zip line extends over the inflatable structure. As such, this embodiment of the inflatable structure advantageously inhibits sagging or toppling over of the zip line regardless of the dimensions of the inflatable structure.

Figure 2:
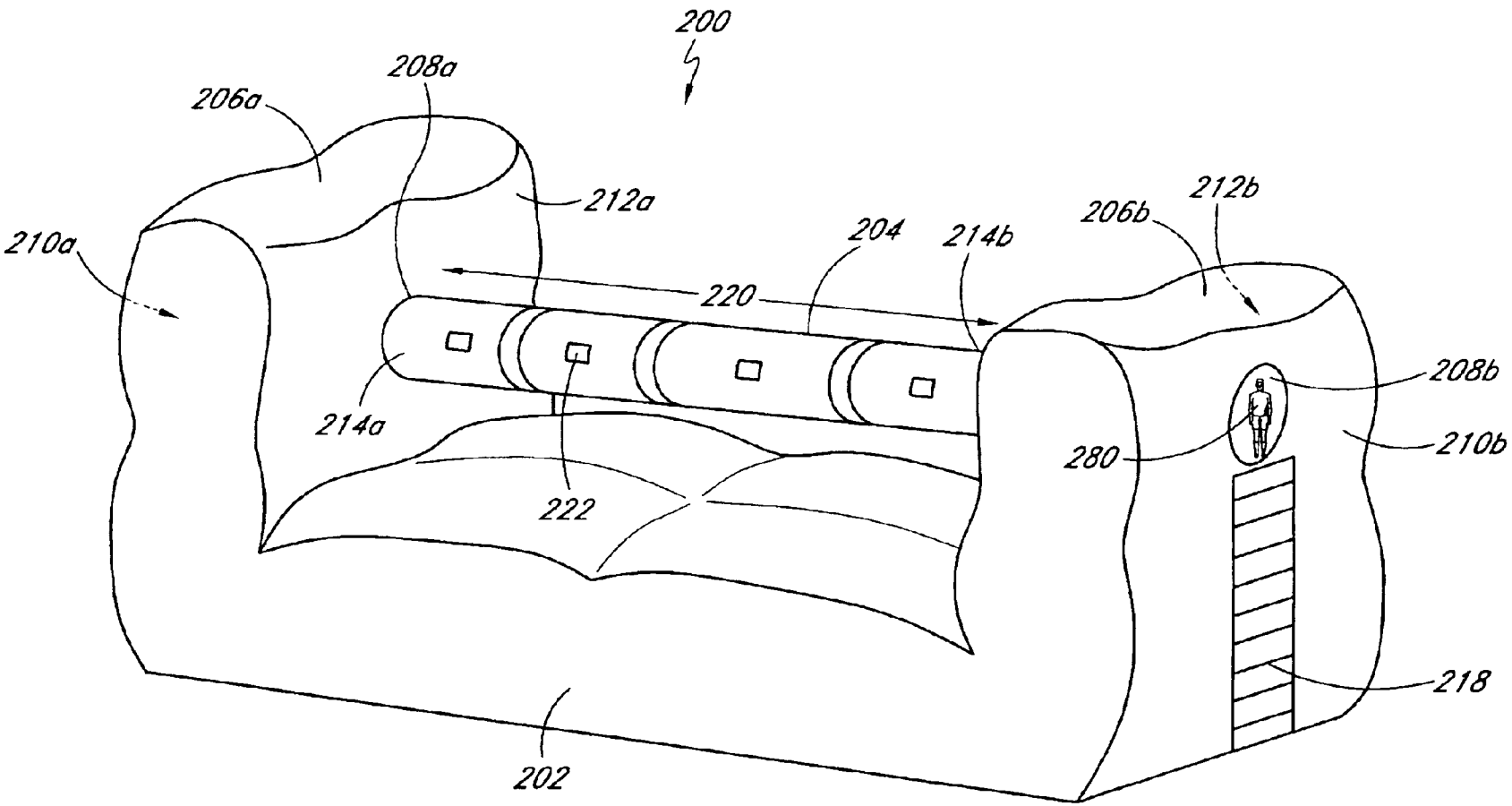
FIG. 2 is a perspective view of another embodiment of an inflatable game incorporating a suspended bridge.

FIG. 2 provides a schematic illustration of another inflatable game 200. The inflatable game 200 comprises an inflatable structure 202 similar to the inflatable structure 102 shown and described in FIG. 1. Moreover, the inflatable game 200 comprises a suspended bridge 204 that extends between two vertical walls 206*a*, 206*b* of the inflatable structure. As will be described in greater detail below, the suspended bridge 204 provides the players with an even wider variety of activities to engage in and thereby increases the player' enjoyment of the inflatable game.

In one embodiment, the inflatable bridge 204 comprises a hollow tube, made of flexible material such as vinyl. Preferably, the bridge 204 is sufficiently large enough to allow a person to crawl through or in some embodiments, to allow a person to walk through in a substantially upright posture. The tunnel can be attached to the inflatable structure via a number of well known attachment processes such as sewing or through the use of adhesives.

In this embodiment, both vertical walls 206*a*, 206*b* further comprise a tunnel 208*a*, 208*b*. The tunnel 208*a*, 208*b* is preferably a hollow tube having a diameter large enough to allow a person to walk therethrough in an upright position. Each tunnel 208*a*, 208*b* extends from an exterior surface 210*a*, 210*b* to a respective interior surface 212*a*, 212*b* so as to provide access to the bridge 204. The tunnels 208*a*, 208*b* are preferably aligned with a first and second end 214*a*, 214*b* of the bridge 204 in a manner such that the tunnels 208*a*, 208*b* and the bridge 204 form a uniform walkway between the vertical walls 206*a*, 206*b*. As is also shown in FIG. 2, a ladder 218 can also be used to enable a person 280 to climb to the tunnel 208*a*, 208*b* leading to the bridge 204.

As shown in FIG. 2, the bridge 204 extends along the first distance 220 at an elevated height above the inflatable structure 202, and as such, the bridge 204 provides the person with a larger array of activities than those currently available in the art. For example, the person 280 can walk or crawl from one section of the inflatable structure to another while suspended high above ground. Furthermore, if the bridge 204 is fixed to the inflatable structure 202 at a slope; the person 180 can use the bridge as a slide that is suspended in midair. Similarly, a sloped bridge can also be used in a competitive game in which people attempt to climb up the bridge 204 in the shortest amount of time. Advantageously, these added activities allow the person 180 to more fully enjoy the inflatable game 200.

Alternative embodiments of the bridge 204 comprise a plurality of viewing windows 222 which are openings created in the bridge 204 at intermittent distances. The viewing widows 222 allow a person to look out over the inflatable structure 202 as the person moves through the bridge 204. Similarly, the sides of the bridge 204, in other embodiments, an also comprise a see-through mesh material through which people can look out over the inflatable structure 102 so that people in the bridge are more aware of their elevation, which is likely to produce more excitement.

Other embodiments of the bridge comprise an elongated horizontal surface with sidewalls extending from the edges of the horizontal surface, but which is open to the sky. As before, this allows people to look out over the inflatable structure and get a sense of the elevation. Also, depending on the elevation of the bridge, people might be able to safely drop from the bridge to the cushioned horizontal mattress 206 for a thrilling free fall. Thus, these alternative embodiments of the suspended bridge produce added enjoyment to the inflatable structure game.

Still in other embodiments, the bridge is not connected to the inflatable structure. The bridge can be attached to rigid structures, such as elevated platforms, lying adjacent to the inflatable structure, and a portion of the bridge extends over the inflatable structure. As such, a person can participate in the same activities described above. Also, as situated, the bridge is less likely to sag or topple over when the user is on the bridge.

Figure 3:
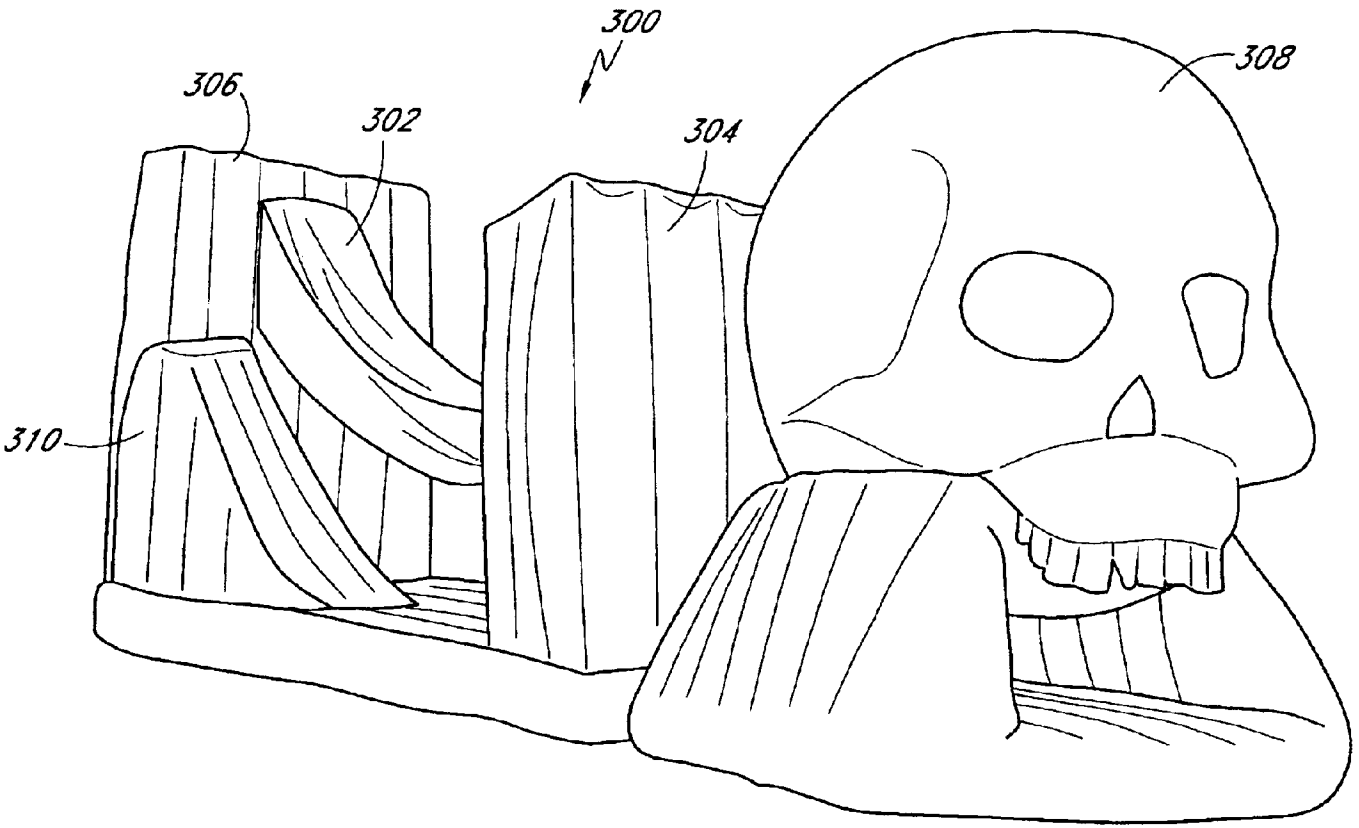
FIG. 3 is a perspective view of yet another embodiment of the inflatable game of FIG. 2.

FIG. 3 illustrates another embodiment of an inflatable structure 300 incorporating a suspended bridge 302. As shown in FIG. 3, the inflatable structure 300 comprises a front and rear wall 304, 306 with the suspended bridge 302 extending therebetween. The front wall 304 can be further supported by an additional structure 308, which in this embodiment is in the configuration of a skull. The additional structure 308 is attached to the front wall 304 in a manner so as to provide added mass to the inflatable structure 300 so as to inhibit the front wall 304 from sagging or toppling over under the weight of people suspended by the bridge 302. As FIG. 3 further shows, the rear wall 306 is also supported by a slide 310 that is attached to the rear wall 306 in a manner so as to inhibit the rear wall 306 from toppling over.

It will be appreciated that the inflatable game of the preferred embodiments can incorporate both a suspended bridge and a zip line without departing from the spirit of the invention. Such an embodiment would allow a person to advantageously engage in all of the activities described above with the same inflatable game. Advantageously, the inflatable structure used in conjunction with the suspended features described above allow the user to engage in new activities, which are not available on current designs of inflatable game. Advantageously, these new activities provide added enjoyment to the user of the inflatable game.

Although the foregoing description of the preferred embodiment of the present invention has shown, described and pointed out the fundamental novel features of the invention, it will be understood that various omissions, substitutions, and changes in the form of the detail of the apparatus as illustrated as well as the uses thereof, may be made by those skilled in the art, without departing from the spirit of the invention.

What is claimed is:

1. An inflatable game, comprising:

a flexible structure, wherein the flexible structure is inflated with a gas; and a suspended structure, wherein the suspended structure extends across at least a portion of the flexible structure, wherein the suspended structure is adapted to allow a person to travel across the portion of the flexible structure while suspended in the air, wherein the suspended structure is integral to the inflatable game; and a horizontal mattress extending between two substantially vertical sidewalls, wherein the suspended structure is mounted to the vertical sidewalls.

2. The inflatable game of claim 1, wherein the suspended structure comprises a zip line.

3. The inflatable game of claim 1, wherein the suspended structure comprises a plurality of sidewalls and a lower wall.

4. The inflatable game of claim 1, wherein the suspended structure does not directly contact a ground surface.

5. The inflatable game of claim 1, wherein the suspended structure comprises a tubular structure.

6. A game for amusement and entertaining, comprising:

a first and a second substantially vertical wall, wherein the walls are flexible and adapted to cushion a person exerting force against the walls, wherein the walls are separated by a first distance;

a substantially horizontal member extending between the walls, wherein the substantially horizontal member is configured to allow a person to move from the first wall to the second wall while suspended above ground; and a substantially horizontal flexible wall positioned below the substantially horizontal member, wherein the horizontal wall extends across the first distance and is separated from the horizontal member by a second distance.

7. A game for amusement and entertaining, comprising:

a first and a second substantially vertical wall, wherein the walls are flexible and adapted to cushion a person exerting force against the walls, wherein the walls are separated by a first distance;

a substantially horizontal member extending between the walls, wherein the substantially horizontal member is configured to allow a person to move from the first wall to the second wall while suspended above ground; and wherein the first and second vertical walls have a width to length ratio of at least 1 to 2.

* * * * *